United States Patent [19]

Jeschke

[11] Patent Number: 4,679,502

[45] Date of Patent: Jul. 14, 1987

[54] REGISTER SYSTEM FOR IN-REGISTER ALIGNMENT OR ORIENTATION OF A FLEXIBLE PRINTING PLATE

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 807,193

[22] Filed: Dec. 9, 1985

Related U.S. Application Data

[63] Continuation of Ser. No. 392,803, Jun. 28, 1982, abandoned, which is a continuation of Ser. No. 59,024, Jul. 19, 1979, abandoned.

[30] Foreign Application Priority Data

Jul. 20, 1978 [DE] Fed. Rep. of Germany ..... 2831921

[51] Int. Cl.[4] ..... B41F 27/06

[52] U.S. Cl. ..... 101/415.1; 101/DIG. 12

[58] Field of Search ..... 101/401.3, 378, 415.1, 101/216, 212, DIG. 12; 33/184.5, DIG. 18

[56] References Cited

U.S. PATENT DOCUMENTS

| | | | |
|---|---|---|---|
| 3,103,880 | 9/1963 | Sanford et al. | 101/DIG. 12 |
| 3,154,012 | 10/1964 | Fischer | 101/415.1 |
| 3,456,587 | 7/1969 | Hulen | 101/415.1 |
| 3,492,900 | 2/1970 | Hill et al. | 33/184.5 X |
| 3,858,512 | 1/1975 | Simeth | 101/415.1 |

FOREIGN PATENT DOCUMENTS

| | | | |
|---|---|---|---|
| 830343 | 2/1952 | Fed. Rep. of Germany | 101/DIG. 12 |
| 2010899 | 9/1971 | Fed. Rep. of Germany | 101/DIG. 12 |
| 2310228 | 9/1974 | Fed. Rep. of Germany | 101/415.1 |
| 700133 | 11/1953 | United Kingdom | 101/DIG. 12 |
| 1220485 | 1/1971 | United Kingdom | 101/181 |

*Primary Examiner*—J. Reed Fisher

*Attorney, Agent, or Firm*—Herbert L. Lerner; Laurence A. Greenberg

[57] ABSTRACT

Register system for in-register alignment of a flexible printing plate on a plate cylinder of a rotary printing machine includes means defining at least two register punch-holes formed in the printing plate and register markings corresponding thereto formed in the plate cylinder, the printing plate having a lower surface towards the plate cylinder and the plate cylinder having a rotary axis, the register markings being at a radial distance from the axis of the plate cylinder at most equal to the radial distance of the lower surface of the printing plate thereform, the register markings comprising respective surface areas slightly smaller than and geometrically similar to a cross-sectional area of the register punch-holes and having an appearance contrasting with the surroundings thereof, the register markings, in clamped condition of the printing plate on the printing cylinder, being disposable in contact-free coincidence with the register punch-holes.

14 Claims, 11 Drawing Figures

REGISTER SYSTEM FOR IN-REGISTER ALIGNMENT OR ORIENTATION OF A FLEXIBLE PRINTING PLATE

This application is a continuation of application Ser. No. 392,803, filed June 28, 1982, now abandoned, which is a continuation application of Ser. No. 059,024, now abandoned.

This invention relates to a register system for in-register alignment of a flexible printing plate on the plate cylinder of a rotary printing machine having at least two register punch-holes formed in the printing plate and corresponding register markings formed in the plate cylinder.

In principle, there are essentially two groups of register systems:

With the first group, the plate is indirectly aligned on the cylinder i.e. first means are provided for aligning the plate in clamping rails and second means are additionally provided for aligning the clamping rails on the cylinder.

The second group dispenses with this roundabout approach. The plate is directly aligned with respect to the cylinder body. The invention of the instant application is applicable to the latter group of register systems.

German Pat. No. DE-PS 830 343 describes a method for in-register clamping in position of printing plates wherein, after copying of the printing plate, the latter is formed with course punch-holes in a region of register crosses which have been copied onto the printing plate, so that the register crosses can be brought into line or alignment with similarly cruciform register markings provided on the plate cylinder. In the course of recent years, this method has proved quite successful since it provides a direct and relatively fast way of aligning a printing plate while any deformations formed in the plate due to the printing plate clamping rails do not have any disadvantageous effect upon the adjusting system. This method has a disadvantage, however, in that the two course punch holes are not constituent parts of a register system, and in that the printing plate is aligned exclusively by the register crosses copied onto the plate.

German Pat. No. DE-PS 20 10 899 discloses a device of the type initially mentioned hereinbefore which avoids the disadvantages of the hereinaforementioned method. Rigid register pins are provided on a common base strip mounted on the front or leading wall of the cylinder gap. These register pins are rectangular in cross-section and project through register slots provided at the leading edge of the printing plate. The front edges of the register pins thus serve as a stop for the defining edges of the register slots. There is, however, a disadvantage in that the edges defining the register slots are deformed by the register pins projecting therethrough when the printing plate is adjusted or clamped circumferentially. Any damage to a register slot incurred during clamping is sufficient to make it no longer possible to pre-align the plate in register during the initial or any subsequent mounting operation. Furthermore, one of the disadvantages of this device in practice is that if a plate has been copied askew, there is no possibility of correcting the error. If, for example, one side of the plate has to be corrected with respect to the other side and the plate is already in contact with the stops, then all that can be done initially is to release the plate tension on the respective side in order, for example, to obtain a parallel line for the leading edge. Following this operation, it is necessary to make an additional circumferential register adjustment of the entire plate cylinder. A corresponding device is, therefore, essential.

Proceeding from this state of the art, it is accordingly an object of the invention to provide a register system of inregister alignment of a flexible printing plate which is relatively easy to operate and which forcibly ensures that the accuracy previously attained when making the printing plate is retained when the plate is used on the press and which permits pracise alignment of a printing plate within very short time interval without damaging or deforming the register punch-holes.

With the foregoing and other objects in view, there is provided in accordance with the invention, a register system for inregister alignment of a flexible printing plate on a plate cylinder of a rotary printing machine comprising means defining at least two register punch-holes formed in the printing plate and register markings corresponding thereto formed in the plate cylinder, the printing plate having a lower surface facing toward the plate cylinder and the plate cylinder having a rotary axis, the register markings being at a radial distance from the axis of the plate cylinder at most equal to the radial distance of the lower surface of the printing plate therefrom, the register markings comprising respective surface areas slightly smaller than and geometrically similar to a cross-sectional area of the register punch-holes and having an appearance contrasting with the surroundings thereof, the register markings, in clamped condition of the printing plate on the printing cylinder, being disposable in contact-free coincidence i.e. alignment or registry with the register.

With such a system, the fixing, clamping and adjustment of the printing plates does not have any disadvantageous effect upon the punch-holes of the register system, and the printing plates can be quickly brought into correct register, even with repeated use, irrespective of deformations and damage in the front or leading-edge clamping region, with the result that, in order to obtain a multicolor print in correct register, it is nearly always unnecessary to readjust the printing plates, although the system allows for such readjustment.

In accordance with another feature of the invention, the means defining the register punch-holes comprise respective lateral surfaces, the lateral surfaces and the surface area geometrically similar to the cross-sectioanl area of the register punch-holes defining contrasting shadow joints therebetween.

In accordance with a more specific feature of the invention, the shadow joints have a blackened appearance, and the surface areas geometrically similar to the cross-sectional area of the register punch-holes have a brightly polished appearance. Thus, any deviations of the printing plate from the in-register position thereof can be noticed especially easily.

In order to increase the adjustment accuracy of the register system and in accordance with a further feature of the invention, the joints have a uniform width of a few tenths of a millimeter.

In order to keep production costs as low as possible, and in accordance with an added feature of the invention, the cross-sectional area of the register punch-holes and the respective surface area geometrically similar thereto have a circular shape. Furthermore, as a completely symmetrical figure, the circle offers ideal alignment possiblities.

In accordance with an alternate feature of the invention, the cross-sectional area of the register punch-holes and the respective surface area geometrically similar thereto have a polygonal shape. A straight shadow joint or an extension thereof can like-wise provide advantages with respect to optical alignment.

In accordance with yet another feature of the invention, the respective surface area geometrically similar to the cross-sectional area of the register punch-holes is on a face of a register pin secured in the plate cylinder, with the face directed towards the printing plate. Such a simple structural arrangement and technically desirable low-cost production permits the furnishing of existing plate cylinders with the register system according to the invention. Furthermore, the similar surface areas used for alignment of the printing plate can easily be exchanged and replaced if they become dirty or worn. In accordance with yet an added feature of the invention, the register system includes plug-in sleeves mounted on the respective register pins and having ends in flush slignment with the faces of the register pins, the end of the plug-in sleeves being formed with annular recesses encircling the register pins, the means defining the register punch-holes comprising respective lateral surfaces, the lateral surfaces and the register pins defining contrasting shadow joints therebetween.

In accordance with yet an additional feature of the invention, the register punch-holes have a substantially circular cross section and the means defining the register punch-holes comprise respective lateral surfaces, the face of the register pin being located on a stud extending from an end of the register pin and having a diameter slightly smaller than that of the cross section of the register punch-holes, a stepped annular surface of the register pin being disposed between the lateral surface of the respective punch-hole and the stud and comprising a contrasting shadow joint.

In accordance with another feature of the invention, the register punch-holes have a substantially circular cross section and the means defining the register punch-holes comprise respective lateral surfaces, the face of the respective register pin being formed with an annular groove enclosing the surface area geometrically similar to the cross-section area of the respective register punch-hole, the annular groove having an inner diameter slightly smaller than the diameter of the substantially circular cross section of the respective register punch-hole, the respective lateral surface and the surface area enclosed by the annular groove defining a contrasting shadow joint therebetween.

In accordance with a further feature of the invention, the register punch-holes have a substantially circular cross section and the means defining the register punch-holes comprise respective lateral surfaces, the face of the respective register pin being formed with a blind bore having at the base thereof the surface area geometrically similar to the cross-sectional area of the respective register punch-hole, the blind bore having a diameter slightly smaller than the diameter of the substantially circular cross section of the respective register punch-hole, the blind bore being dark in color relative to the surroundings thereof.

In accordance with an added feature of the invention, the means defining the register punch-holes comprise respective lateral surfaces, the plate cylinder having annular grooves directly incised therein and enclosing the respective surface areas smaller than and geometrically similar to the cross-sectional area of the respective register punch-holes, the respective lateral surfaces and the respective smaller surface areas defining respective shadow joints therebetween viewable from above the printing plate.

In accordance with a concomitant feature of the invention, the means defining the register punch-holes comprise respective lateral surfaces, the polygonal shape being triangular, the respective surface area geometrically similar to the cross-sectional area of the register punch-hole being on a triangular face of a register pin secured in the plate cylinder, the triangular face being located on a stud extending from an end of the register pin and having a triangular cross-sectional area slightly smaller than that of the respective register punch-hole, the respective lateral surfaces and the stud defining regions therebetween viewable from above the printing plate and comprising contrasting shadow joints. Other features which are considered as characteristic of the invention are set forth in the appended claims.

Although the invention is illustrated and described hereinas embodied in a register system for in-register alignment or orientation of a flexible printing plate, it is nevertheless not intended to be limited to the details shown, since various modifications and structural changes may be made therin without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
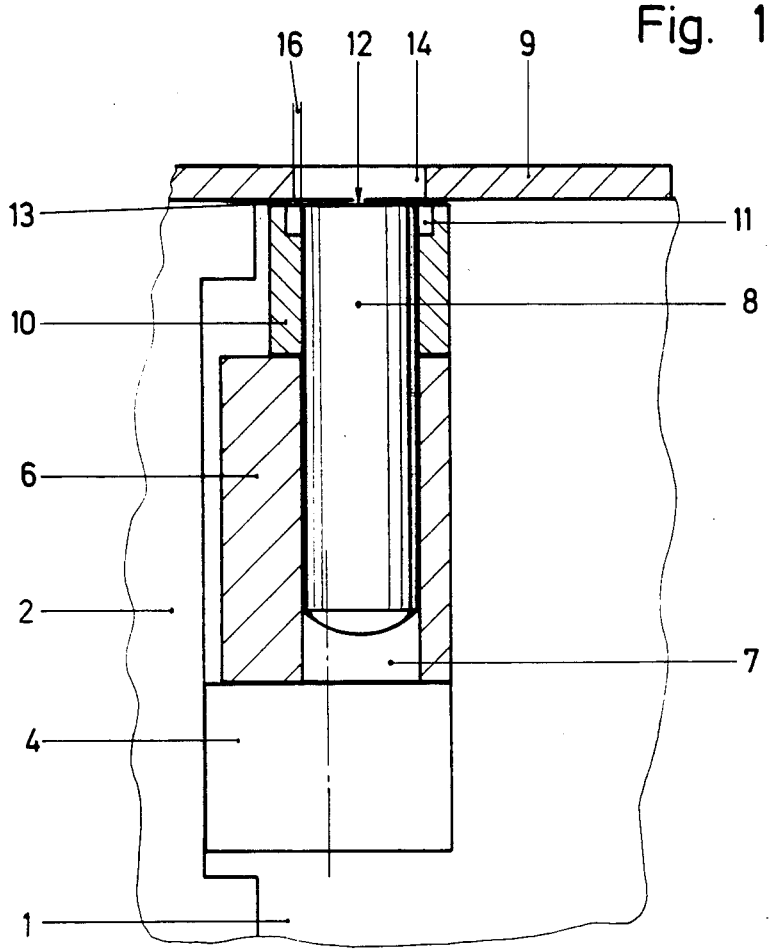
FIG. 1 is a fragmentary cross-sectional view of a basic register system construction in accordance with the invention forming part of a plate cylinder.
Figure 2:
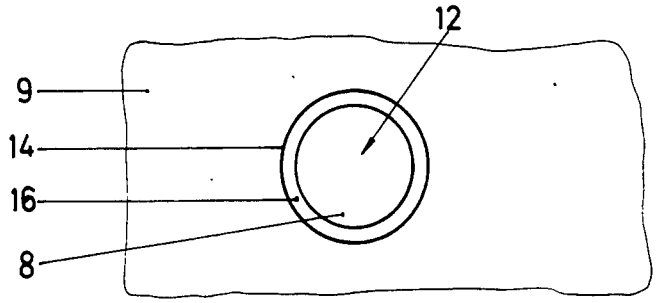
FIG. 2 is a top plan view of FIG. 1.
Figure 4:
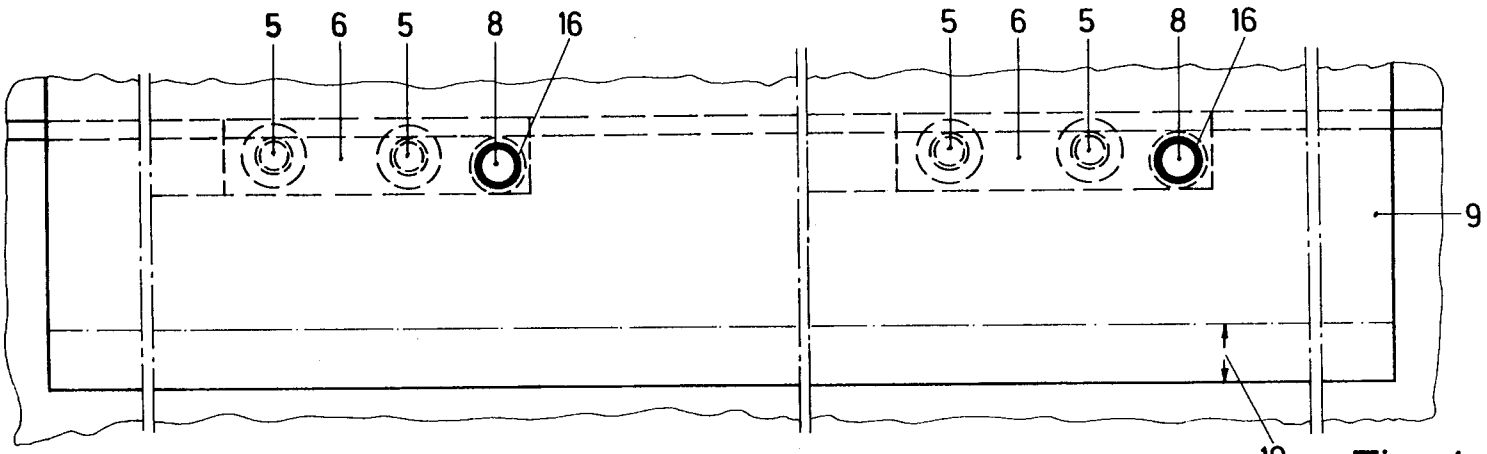
FIG. 4 is a view similar to that of FIG. 3 wherein the printing plate is aligned.

Referring now to the drawing and first , particularly, to FIGS. 1 to 5 thereof, there are shown, in a basic construction of the invention, retaining members 4 fastened at an exact mutual spacing and axially parallel to one another at opposite ends of a cylinder gap 1 of a plate cylinder 2, at the side of the cylinder gap 1 facing toward the leading edge, the retaining members 4 being adjustable in longitudinal direction of the cylinder gap 1 by means of screws 3. An intermediate carrier members 6 which is adjustable in vertical direction by means of set screws 5 is screwed to each retaining member 4. The intermediate carrier member 6 is formed with a throughbore 7 which accomodates a register bolt or pin 8.

The register pin 8 is provided with a firmly seated or tightfitting plug-in sleeve 10 at the end thereof facing toward a printing plate 9 projecting into the cylinder gap 1, the plugin sleeve 10 at an end thereof being formed with a circular recess 11 and terminating flush with the face 12 of the register pin 8. The face 12 of the register pin 8 as well as the plug-in sleeve 10 secured thereon are both surface-ground and brightly polished similarly to the printing-plate surface. The bottom surface of the circular recess 11 surrounding the register pin or bolt 8 contrasts with the face 12 of the register bolt 8 enclosed thereby, with the annular surface of the plug-in sleeve 10 by which it is surrounded as well as with the surface of the printing plate 9. This contrast being effected by, for example, deadening or dulling the bottom annular surface of the recess 11. The circular recess 11 is preferably colored black and thereby forms a sharp, visually readily apparent contrast with herein aforementioned surfaces.

In assembled condition i.e. in flat position, of the printing plate 9, a gap 13 of a few hundredths of a millimeter exists between the lower edge of the printing plate 9 and the upper edge of the register bolt 8. This gap 13 is not absolutely necessary, however, and can also be dispensed with.

The printing plate 9 projecting into the cylinder gap 1 is clamped within the clamping range 19 thereof (FIG. 5) by means of clamping screws 15 (diagrammatically represented in FIG. 5) in clamping rails 18 of an otherwise non-illustrated nor further described printing-plate clamping device such as has become known heretofore from German Pat. No. DE-PS 23 10 228. The printing plate 9, during manufacture and before plate duplication, has beforehand been formed , by means of a register punch, with two circular register punch-holes 14 in the region of the register bolts 8 and at the leading edge of the printing plate 9, the punch-holes 14 having exactly the same mutual spacing as that of the register bolts 8 and having a diameter which is a few tenths of a millimeter greater that that of the faces 12 of the register bolts 8. Due to the darker coloring of the circular recesses 11 with respect to the surroundings thereof, the regions thereof visible from above the printing plate 9 and disposed between the sides of the register punch-holes 14 and the register pins or bolts 8, form readily perceptible, contrasting shadow joints 16.

No further discussion in detail is had herein regarding the system used for the plate duplication to apply the films in correct register to the printing plates 9 in relation to the register punch-holes 14, because such a discussion would be beyond the scope of the invention. It is self-evident, of course that the register punch-holes 14 are produced either together with punch-holes for adjusting or aligning the film or that the register punch-holes 14 serve directly for adjusting or aligning the film.

The manner of operation as well as the application or use of the basic construction of the register system for in-register aligning of the printing plate 9 on the plate cylinder 2 is effected as follows.

The printing plate 9 is clamped in the clamping rails 18 in a conventional manner by means of the clamping screws 15. In order then to align the printing plate 9 in exact register, the printer sights the faces 12 on the register bolts 8 through both axially parallel, circular register punch-holes 14 formed in the printing plate 9 and brings them into alignment with one another.

Figure 3:
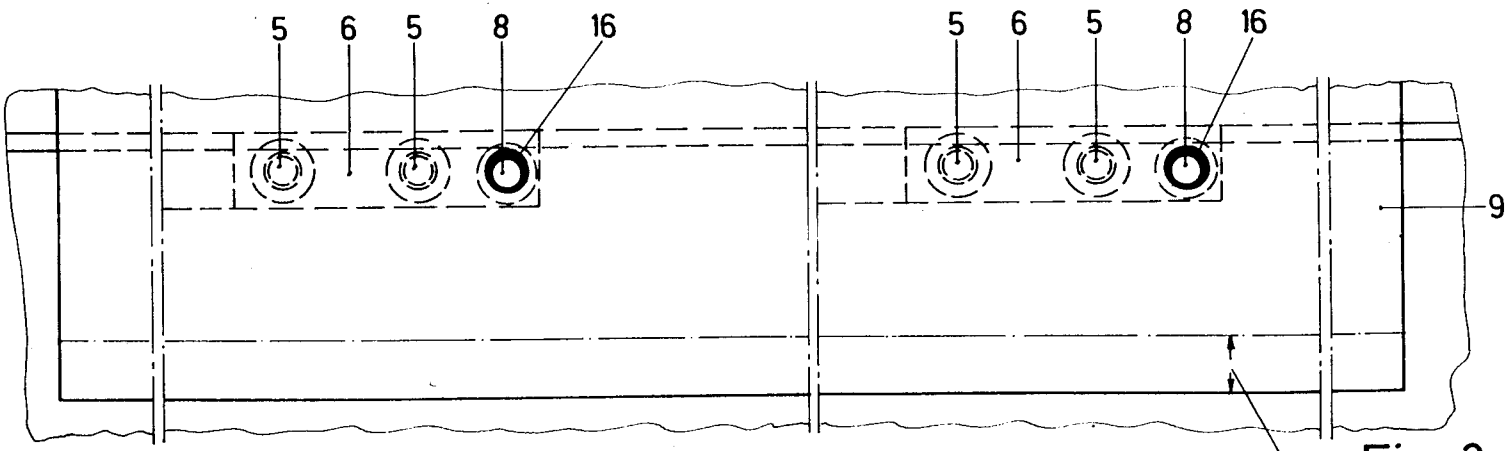
FIG. 3 is a fragmentary diagrammatic top plan view of a non-aligned printing plate at the cylinder gap of a plate cylinder showing, at reduced scale, the resister system of FIGS. 1 and 2 at the leading edge of the plate.

Before aligning the printing plate 9, the printer is presented with a view somehwat like that provided in FIG. 3. Both register punch-holes 14 of the printing plate 9 are eccentrically offset with respect to the faces 12 of the register bolts 8 similar thereto. This is clearly apparent especially due to the eccentric offset of the shadow joints 16, which surround the faces 12, with respect to the corresponding register punchholes 14.

By means of setscrews of the otherwise non-illustrated nor further described printing-plate clamping device, the leading edge of the printing plate 9 held by the printing-plate clamping rails 18 is then adjusted and aligned until concentric agreement between both register punch-holes 14 of the printing plate 9 and both faces 12 of the register bolts or pins 8 is effected.

Warping or compressing of the leading edge of the printing plate 9 due to the clamping thereof has completely no effect upon the register punch-holes 14 of the employed register system, so that the printing plates 9 provided and once previously aligned therewith can readily be used many times i.e. repeatedly clamped and newly aligned without thereby losing the accuracy of the register system attained during manufacture.

Due to the contrasting coloring of the recesses 11 serving as shadow joints 16 in the basic construction of the register system and due to the choice of a narrow width of the shadow joints 16 of only a few tenths of millimeter, a high degree of accuracy of the register system is achieved, as a result of which the printer can perceive very readily even the slightest eccentric offset of the faces 12 with respect to the register punch-holes 14 and therewith minimal deviations of the printing plate 9 from the in-register position thereof. It has been found in practice that, due to the high degree of accuracy of the register system, a single alignment of the printing plates 9 is completely adequate for attaining an in-register multicolor print.

It is moreover of particular advantage also that this register system, precisely because of the herinaforementioned accuracy thereof, can be used along or also as a supplement to previously existing, cruder or less accurate register systems.

Figure 5:
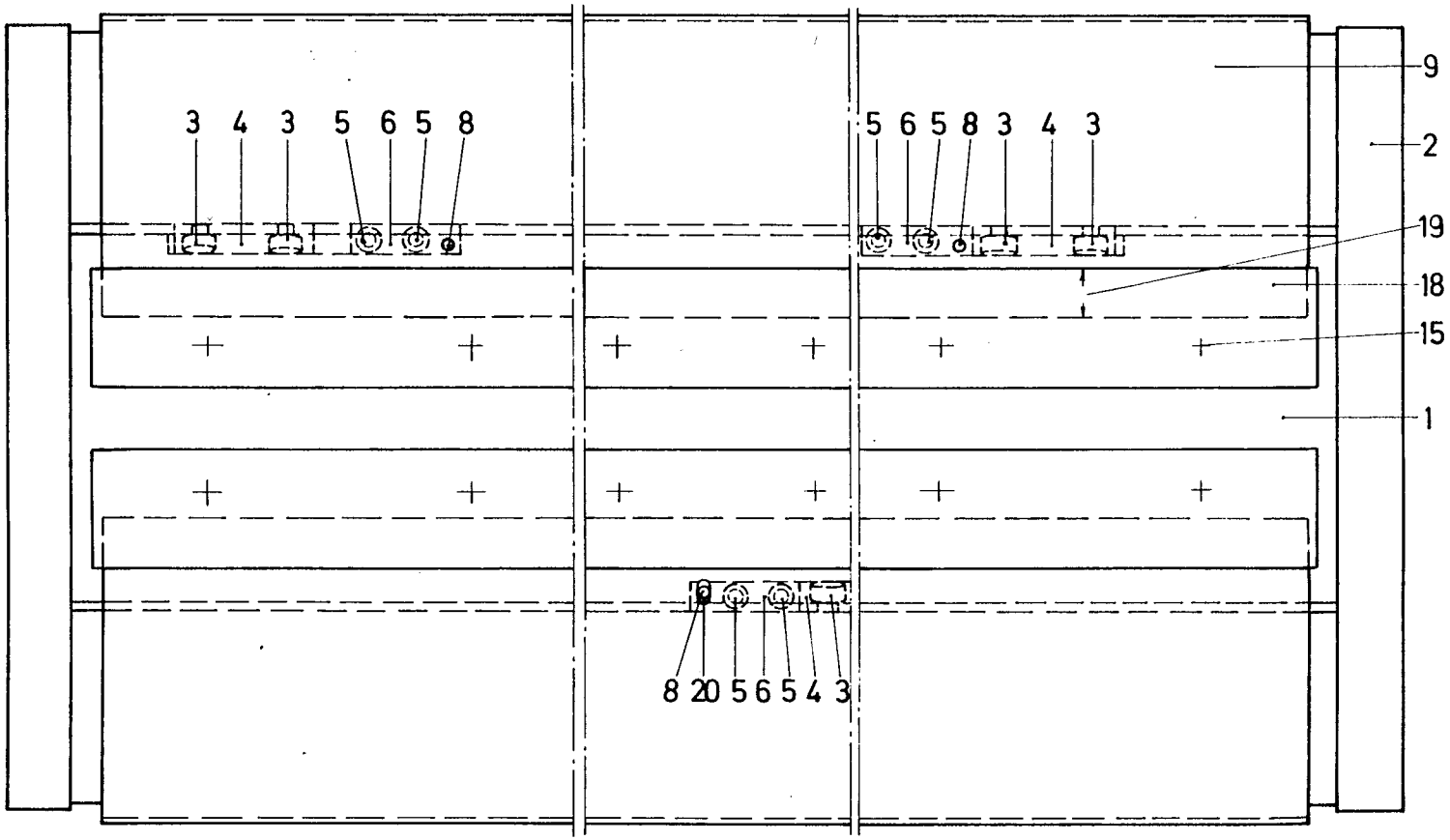
FIG. 5 is a diagrammatic top plan view of a plate cylinder showing, at reduced scale, the register system of FIG. 4, with a third register bolt or pin additionally located at the trailing edge of the plate.

In order to provide additional assistance in the lateral alignment of the printing plate 9 at the trailing end thereof, as shown in FIG. 5, a third register bolt or pin 8 of the same structural disposition as that of the aforementioned two register bolts 8 can additionally be provided in the middle at the side of the cylinder gap 1 facing toward the trailing end of the printing plate 9. Since varying printing lengths may be produced also in circumferential direction due to varying overlay or underlay thickness, no individual circular register punch-holes 14 like those at the leading edge of the printing plate 9 can be used at the trailing edge thereof. Instead, the rear or trailing region of the printing plate 9 must be formed with a slot or oblong hole 20 the elongated lateral edges of which must both be spaced the same distance from the face 12 of the rear register bolt 8 (FIG. 5), when the printing plate 9 is aligned. The provision of an additional register bolt or pin 8 disposed at the trailing edge of the printing plate 9 is not essential to the invention, however.

Figure 6:
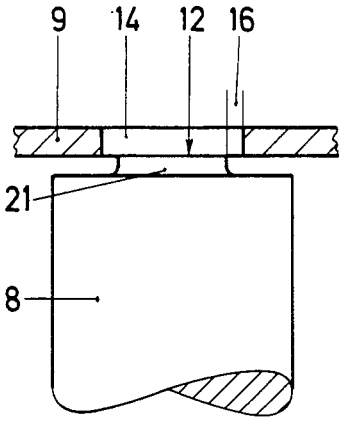
FIGS. 6 to 10 are similar fragmentary diagrammatic, at least partly sectional views of various different embodiments of the register system according to the invention.

In a first specific embodiment of the register system according to the invention shown in FIG. 6, the register bolts or pins 8, at the ends thereof facing towards the printing plate 9, are provided with a circular stud 21 formed with a slightly smaller diameter than that of the corresponding circular register punch-hole 14 formed in the printing plate 9. The shadow joints 16, in the embodiment of FIG. 6, are formed by that part of the annular surfaces of the register bolts 8 surrounding the circular studs 21 and visible through the circular register punch-holes 14 formed in the printing plate 9.

Figure 7:
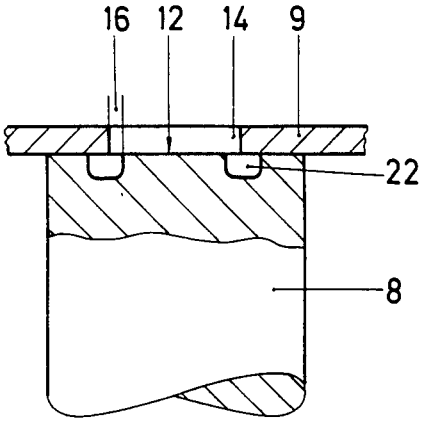

A second specific embodiment of the register system according to the invention, as shown in FIG. 7, has shadow joints 16 in the form of annular groove 22 incised into the faces of the register bolts or pins 8 and having an inner diameter slightly smaller, preferably by a few tenths of a millimeter, than the diameter of the corresponding register punch-holes 14 formed in the printing plate 9. The annular or ring grooves 22 are preferably colored black. In the embodiment of FIG. 7, the shadow joints 16 result from the regions of the annular grooves 22 lying between the sides of the register punch-holes 14 and the lateral surface at the inner diameter of the annular grooves 22 and visible from above the printing plate 9.

Figure 8:
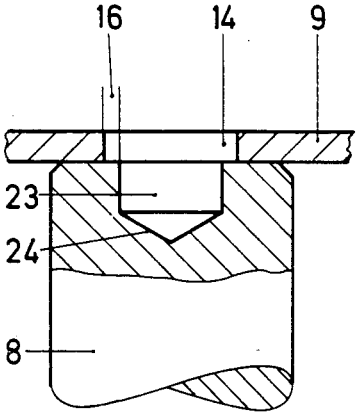

Register bolts or pins 8 of a third special embodiment of the register system according to the invention shown in FIG. 8 are provided at the end face thereof with respective blind bores 23 having a slightly small diameter than that of the register punch-holes 14 of the printing plate 9. In this embodiment of FIG. 8, a separate contrasting of individual surfaces is not absolutely necessary, yet expediently promotes or amplifies the contrasting effect since the contrast of the surface governing the alignment of the printing plate 9 results from the fact that the base of the blind bore 24 is darker than the surrounding thereof. Depending upon the depth of the blind bores 23, the base thereof may be lighter or darker.

Figure 9:
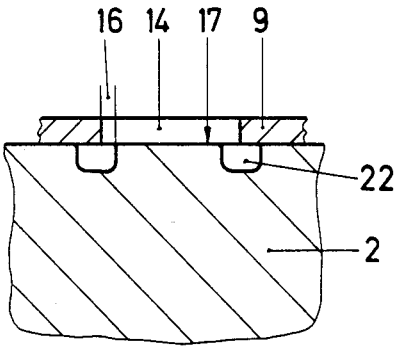

In a fourth specific embodiment of the register system, as shown in FIG. 9, the ring or annular grooves 22 are incised directly into the surface of the plate cylinder 2 without any interposition of register bolts or pins. In this embodiment of FIG. 9, the similar areas or surfaces serving for aligning the printing plate 9 are circular areas or surfaces 17 formed on the plate cylinder 2 and enclosed by the annular grooves 22. The shadow joints 16 are formed by the regions of the contrastingly colored annular grooves 22 visible from above the printing plate 9 and located between the sides of the circular register punch-holes 14 and the lateral surface at the inner diameter of the annular grooves 22.

Figure 10:
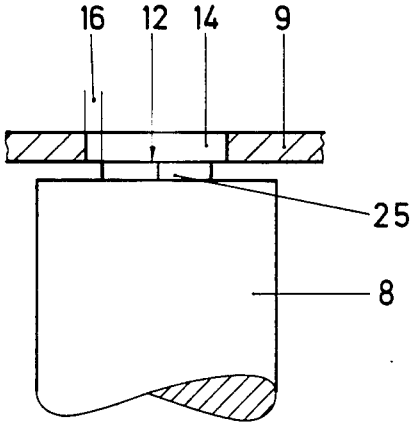
Figure 11:
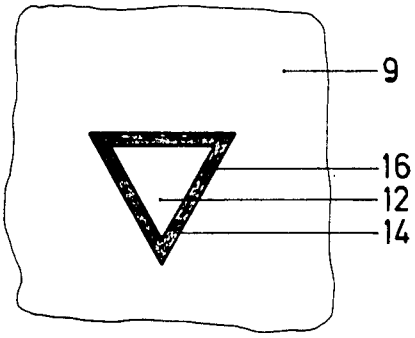
FIG. 11 is a top plan view of FIG. 10.

Naturally, the similar surfaces or areas serving for aligning the printing plate 9 may also be polygonal instead of circular. This is the case for a fifth embodiment of the register system shown in FIGS. 10 and 11 wherein the register punch-holes 14 formed in the printing plate 9 and the smaller faces 12 of the register bolts or pins 8 similar thereto are triangular in shape, and are preferably in the form of equilateral triangles. The faces 12 are located on triangular studs 25 provided at the ends of the register bolts 8. The regions of the thus step-shaped register bolts 8 disposed between the sides of the register punch-holes 14 and the studs 25 form the shadow joints 16 when viewed from above the printing plate 9.

As noted hereinbefore, the invention is in no way restricted to the embodiments described hereinbefore and shown in the figures. These embodiments should merely be viewed as examples which do not limit the scope of the invention. Needless to say, other embodiments with numerous modification of structural details thereof are conceivable and will yet lie within the scope of the invention.

Thus, for example, other curved or polygonal shapes may be used for the register punch-holes 14 of the printing plate 9 and for the surfaces or areas 12 similar thereto. It is irrevelant, in this regard, whether the similar areas or surfaces 12 are incised directly into the plate cylinder 2 or into the register bolts 8 or whether they are located instead on studs 21, 25 at the end of the register bolts 8. It is likewise within the scope of the invention to provide only a single register bolt 8 at both the leading and the trailing edges of the printing plate 9 instead of providing two register bolts 8 at the leading edge and one thereof at the trailing edge, or to reverse the contrasting effect i.e. to make the similar areas or surfaces 12 dark and the areas or surfaces surrounding the latter light or brightly polished.

There are claimed:

1. Register system of in-register alignment of a flexible printing plate on a plate cylinder of a rotary printing machine comprising means defining at least two register punch-holes formed in the printing plate and register markings corresponding thereto formed in the plate cylinder, the printing plate having a lower surface facing towards the plate cylinder and the plate cylinder having a rotary axis, said register markings being at a radial distance from the axis of the plate cylinder at most equal to the radial distance of the lower surface of the printing plate therefrom, said register markings comprising respective surface areas slightly smaller than and geometrically similar to a cross-sectional area of said register punch-holes and having a appearance contrasting with the surroundings thereof, said means defining said register punch-holes being respective edges of the printing plate and, in clamped condition of the printing plate on the printing cylinder, being spaced from and being adjustable in relation to the contours of said register markings in the printing cylinder, said printing plate remaining contact-free in relation to said register markings during adjustment of said means defining said register punch-holes in relation to the contours of said register markings.

2. Register system according to claim 1 wherein said means defining said register punch-holes comprise respective lateral surfaces, said lateral surfaces and said surface areas geometrically similar to the cross-sectional area of said register punch-holes defining contrasting shadow joints therebetween.

3. Register system according to claim 2 wherein said shadow joints have a blackened appearance, and said surface areas geometrically similar to the cross-sectional area of said register punch-holes have a brightly polished appearance.

4. Register system according to claim 2 wherein said shadow joints have a uniform width of a few tenths of a millimeter,

5. Register system according to claim 1 wherein the crosssectional area of said register punch-holes and the respective surface area geometrically similar thereto have a circular shape.

6. Register system according to claim 1 wherein the crosssectional area of said register punch-holes and the respective surface area geometrically similar thereto have a polygonal shape.

7. Register system according to claim 1 wherein each of the respective surface areas geometrically similar to the cross-sectional area of said register punch-holes is on a face of a respective register pin secured in the plate cylinder, with said face directed towards the printing plate.

8. Register system according to claim 7 including an adjustable intermediate support member carried by the plate cylinder, said register pin being mounted on said intermediate support member.

9. Register system according to claim 7 wherein the register punch-holes have a substantially circular cross section and said means defining the register punch-holes comprise respective lateral surfaces, said face of the register pin being located on a stud extending from an end of the register pin and having a diameter slightly smaller than that of the cross section of the register punch-holes, a stepped annular surface of the register pin being disposed between the lateral surface of the respective punch-hole and said stud and comprising a contrasting shadow joint.

10. Register system according to claim 7 wherein the register punch-holes have a substantially circular cross section and said means defining the register punch-holes comprise respective lateral surfaces, said face of the respective register pin being formed with an annular groove enclosing said surface area geometrically similar to the cross-sectional area of the respective register punch-hole, said annular groove having an inner diameter slightly smaller than the diameter of the substantially circular cross section of the respective register punch-hole, the respective lateral surface and said surface area enclosed by said annular groove defining a contrasting shadow joint therebetween.

11. Register system according to claim 7 wherein the register punch-holes have a substantially circular cross section and said means defining the register punch-holes comprise respective lateral surfaces, said face of the respective register pin being formed with a blind bore having at the base thereof said surface area geometrically similar to the cross-sectional area of the respective register punch-hole, said blind bore having a diameter slightly smaller than the diameter of the substantially circular cross section of the respective register punch-hole, said blind bore being dark in color relative to the surroundings thereof.

12. Register system according to claim 1 wherein said means defining the register punch-holes comprise respective lateral surfaces, the plate cylinder having annular grooves directly incised therein and enclosing the respective surface areas smaller than and geometrically similar to the cross-sectional area of the respective register punch holes, the respective lateral surfaces and the respective smaller surface area defining respective shadow joints therebetween viewable from above the printing plate.

13. Register system according to claim 6 wherein said means defining the register punch-holes comprise respective lateral surfaces, said polygonal shape being triangular, the respective surface are geometrically similar to the cross-sectional area of said register punch-holes being on a triangular face of a register pin secured in the plate cylinder, said triangular face being located on a stud extending from an end of the register pin and having a triangular cross-sectional area slightly smaller than that of the respective register punch-hole, said respective lateral surfaces and said stud defining regions therebetween viewable from above the printing plate and comprising contrasting shadow joints.

14. Register system for in-register alignment of a flexible printing plate on a plate cylinder of a rotary printing machine comprising means defining at least two register punch-holes formed in the printing plate and register markings corresponding thereto formed in the plate cylinder, the printing plate having a lower surface facing towards the plate cylinder and the plate cylinder having a rotary axis, said register markings being at a radial distance from the axis of the plate cylinder at most equal to the radial distance of the lower surface of the printing plate therefrom, said register markings comprising respective surface areas slightly smaller than and geometrically similar to a cross-sectional area of said register punchholes and having an appearance contrasting with the surroundings thereof, said register markings disposable in contact-free coincidence with said register punch-holes, each of the respective surface areas geometrically similar to the cross-sectional area of said register punch-holes being on a face of a respective register pin secured in the plate cylinder, with said face directed towards the printing plate including plug-in sleeves mounted on the respective register pins and having ends in flush alignment with said faces of the register pins, said ends of said plug-in sleeves being formed with annular recesses encircling the register pins, said means defining said register punch-holes comprising respective lateral surfaces, said lateral surfaces and said register pins defining contrasting shadow joints therebetween.

* * * * *